US005172869A

United States Patent [19]

Kitsukawa et al.

[11] Patent Number: 5,172,869

[45] Date of Patent: Dec. 22, 1992

[54] JAW CRUSHER

[75] Inventors: Tomohiro Kitsukawa; Yoshihiko Isebaba, both of Tokyo; Kazuhisa Hirano, Taku; Masanao Hirakawa, Tokyo, all of Japan

[73] Assignee: Nakayama Iron Works, Ltd., Takeo, Japan

[21] Appl. No.: 877,360

[22] Filed: May 1, 1992

Related U.S. Application Data

[63] Continuation of Ser. No. 644,815, Jan. 23, 1991, abandoned.

[30] Foreign Application Priority Data

Jan. 25, 1990 [JP] Japan ..... 2-6247
Jul. 23, 1990 [JP] Japan ..... 2-77472

[51] Int. Cl.[5] ..... B02C 23/02
[52] U.S. Cl. ..... 241/264; 241/265
[58] Field of Search ..... 241/264-269

[56] References Cited

U.S. PATENT DOCUMENTS 4.406,416 9/1983 Tateishi ..... 241/269
4.679,742 7/1987 Ellis ..... 241/267 X

FOREIGN PATENT DOCUMENTS 34756 6/1908 Austria ..... 241/269
20423 6/1971 Japan ..... 241/264
60-147252 8/1985 Japan .
63-185453 11/1988 Japan .
329000 4/1972 U.S.S.R. ..... 241/264

*Primary Examiner*—Douglas D. Watts
*Attorney, Agent, or Firm*—Armstrong & Kubovcik

[57] ABSTRACT

A jaw crusher with a pass-through preventing device which prevents a flat plate-shaped object from passing through without being crushed. Also disclosed is a jaw crusher with a tooth plate structure which is capable of effectively crushing a non-rigid object, for example, a lump of asphalt, without causing such an object to stick to the area between a cheek plate and a fixed tooth plate or a movable tooth plate. The jaw crusher comprises a plurality of forks which are provided at the lower end of a crushing space to prevent a plate-shaped object from passing through the crushing space without being crushed, and a fork shaft which is provided with one end of each fork and which is rotatably provided on the crusher body. The movable tooth plate is provided with cutting projections. A plate-shaped object is first broken by the cutting projections and then crushed by intermediate projections.

8 Claims, 7 Drawing Sheets

FIG.10 PRIOR ART (a)

FIG.10 PRIOR ART (b)

FIG.10 PRIOR ART (c)

JAW CRUSHER

This application is a continuation of application Ser. No. 07/644,815 filed Jan. 23, 1991 now abandoned.

BACKGROUND OF THE INVENTION

1. Field of the Invention

The present invention relates to an improvement in jaw crusher. More particularly, the present invention relates to a jaw crusher for breaking asphalt pavement wastes, concrete scraps, etc which has a pass-through preventing device to prevent an object of crushing from passing through the area between a fixed tooth plate and a movable tooth plate without being crushed, together with a crushing tooth plate structure that is improved in the crushing performance.

2. Description of the Prior Art

Jaw crushers are known and used as machines for breaking rocks, asphalt pavement wastes, concrete scraps, etc. into pieces of desired size. These days, a large amount of concrete scrap and asphalt pavement waste are produced by dismantling of concrete buildings, repair of asphalt pavements, etc. Treatment of these wastes, particularly in urban areas, gives rise to a social problem because of the generation of noise and dust during the treatment, difficulty in securing a place for dumping wastes, a high cost of waste transportation, etc.

For this reason, these wastes are desired to be speedily treated and reused at or near the site where the wastes are produced, as much as possible When such wastes are crushed with a jaw crusher, a thin waste material may pass through the crushing space between a fixed tooth plate and a movable tooth plate to come out of a discharge opening without being crushed. When the lower end portion of the fixed or movable tooth plate has become worn, the size of the discharge opening enlarges, so that a plate-shaped waste material, for example, a concrete lid for a road side ditch, may pass through the crushing space to drop out of the discharge opening without being crushed.

A jaw crusher wherein a square bar is disposed in an outlet of an object of crushing not to prevent the object from passing through without being crushed but to control the size of pieces of the crushed object is known as Japanese Utility Model Laid-Open (KOKAI) No. 63-185453 (Date of public disclosure: Nov. 29, 1988; Applicant: Sankyo Kikai K. K.). In this mechanism, no retracting mechanism is provided and hence the square bar is constantly exposed to the object of crushing.

To crush non-rigid objects, for example, asphalt, it has been conventional practice to use tooth plate structures shown in FIGS. 10(*a*) and 10(*b*), which are designed to crush rigid objects, e.g., aggregates, concrete, etc., or a tooth plate structure shown in FIG. 10(*c*), which is devised to crush non-rigid objects. However, in these prior arts, a groove-shaped recess 86 is defined between a cheek plate 80 that is attached to a side plate of a machine frame and a fixed tooth plate 85*a* that is attached to the machine body, as shown in FIGS. 10(*a*), 10(*b*) and 10(*c*).

For this reason, a non-rigid object is pressed by a movable tooth plate 85*b* that is attached to a swing frame in such a manner that the object is confined in the recess 86, resulting in the object sticking to the cheek plate 80, the fixed tooth plate 85*a* and the movable tooth plate 85*b* in the form of a fixed object Ga. The fixed object Ga obstructs the falling of other objects of crushing and hence lowers the crushing capacity.

In the meantime, a tooth plate structure which is designed to break an object by bending is known. For example, Japanese Patent Laid-Open (KOKAI) No. 60-147252 (Date of public disclosure: Aug. 3, 1985; Applicant: Kawasaki Jukogyo K.K.) proposes a tooth plate structure which is designed to cut blast furnace slag by bending. However, this tooth plate structure is adapted for breaking by bending only and is not very effective in crushing.

SUMMARY OF THE INVENTION

The present invention provides a jaw crusher which is free from the above-described problems of the prior art.

According to one aspect of the present invention, there is provided a jaw crusher for breaking a non-rigid object comprising: a body; a fixed tooth plate which is secured to the body; a movable tooth plate which is swingably provided at an acute angle to the fixed tooth plate to provide therebetween a crushing space for breaking an object which is to be crushed; a swing jaw to which the movable tooth plate is secured; a driving mechanism for swinging the swing jaw; a motor for driving the driving mechanism; a plurality of forks which are provided at the lower end of the crushing space to prevent the object from passing through the crushing space without being crushed; and a fork shaft which is provided with one end of each of the forks and which is rotatably provided on the body.

According to another aspect of the present invention, there is provided a jaw crusher for breaking a non-rigid object comprising: a body; a fixed tooth plate which is secured to the body; a movable tooth plate which is swingably provided at an acute angle to the fixed tooth plate to provide therebetween a crushing space for breaking an object which is to be crushed; a swing jaw to which the movable tooth plate is secured; a driving mechanism for swinging the swing jaw; a motor for driving the driving mechanism; relatively high cutting projections which are provided on either the fixed or movable tooth plate at a predetermined pitch to bend and cut the object which is put between the fixed and movable tooth plates; crushing projections each of which is provided substantally at the middle between each pair of adjacent cutting projections, the crushing projections being lower than the cutting projections; and projections which are provided on the other of the fixed and movable tooth plates at a predetermined pitch.

OBJECTS AND ADVANTAGES OF THE INVENTION

It is an object of the present invention to provide a jaw crusher with a pass-through preventing device which prevents a flat plate-shaped object from passing through without being crushed.

It is another object of the present invention to provide a jaw crusher with a pass-through preventing device which is designed so that the impact of a flat plate-shaped object when thrown in is lessened.

In the jaw crusher of the present invention, a pass-through preventing device is disposed at the object discharge position, so that even a thin plate-shaped object can be effectively crushed without passing through in vain. In addition, since the object of crushing is received by means of hydraulic pressure, pneumatic pressure and spring force, the forks can move effectively without being damaged.

It is still another object of the present invention to provide a jaw crusher with a tooth plate structure which enables even a non-rigid object, for example, a lump of asphalt, to be efficiently crushed without sticking to the area between the cheek plate and the fixed tooth plate.

The tooth plate structure of the present invention effects breaking by bending and, at the same time, cutting by the effect of wedge and then performs breaking by crushing.

BRIEF DESCRIPTION OF THE DRAWINGS

FIG. 9(*b*) is a sectional view of a third embodiment of the tooth plate structure; and FIGS. 10(*a*), 10(*b*) and 10(*c*) are sectional views of conventional tooth plate structures.

DESCRIPTION OF THE PREFERRED EMBODIMENTS First embodiment

Figure 1:
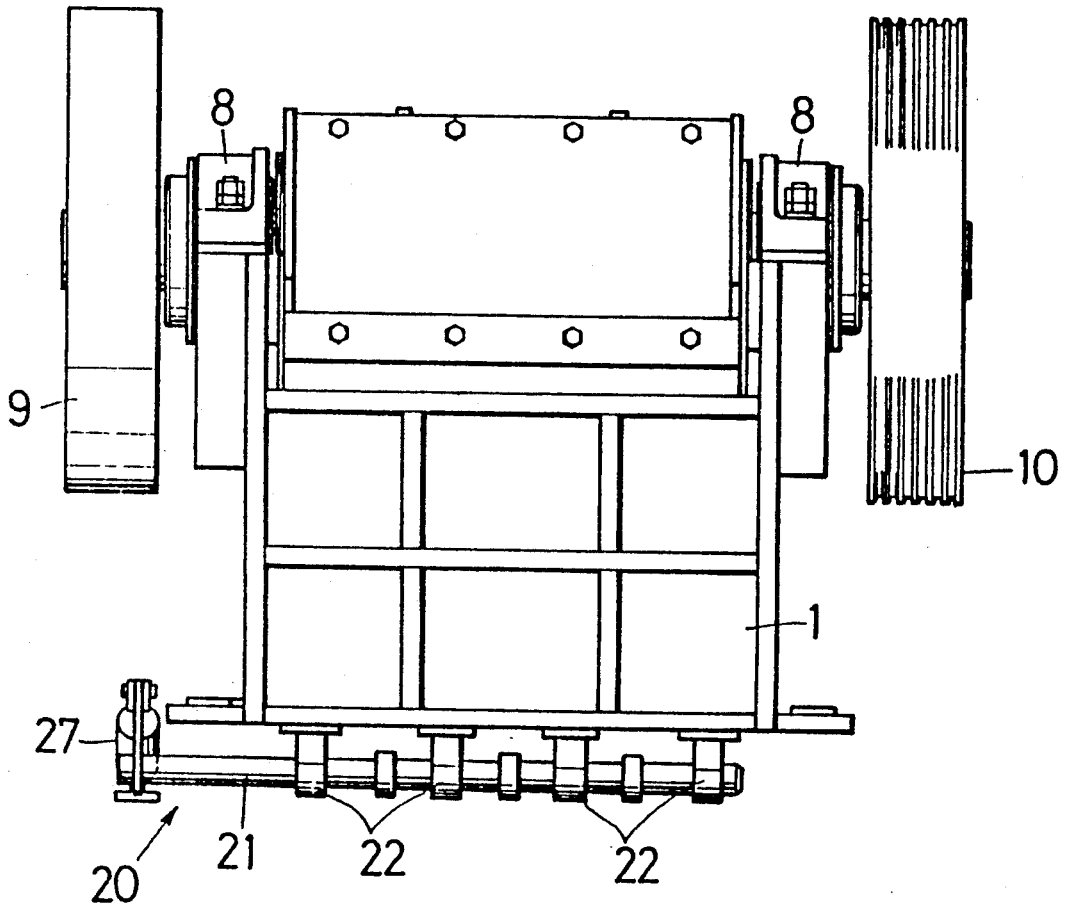
FIG. 1 is a front view of the jaw crusher with a pass-through preventing device according to the present invention, showing a first embodiment of the pass-through preventing device.
Figure 2:
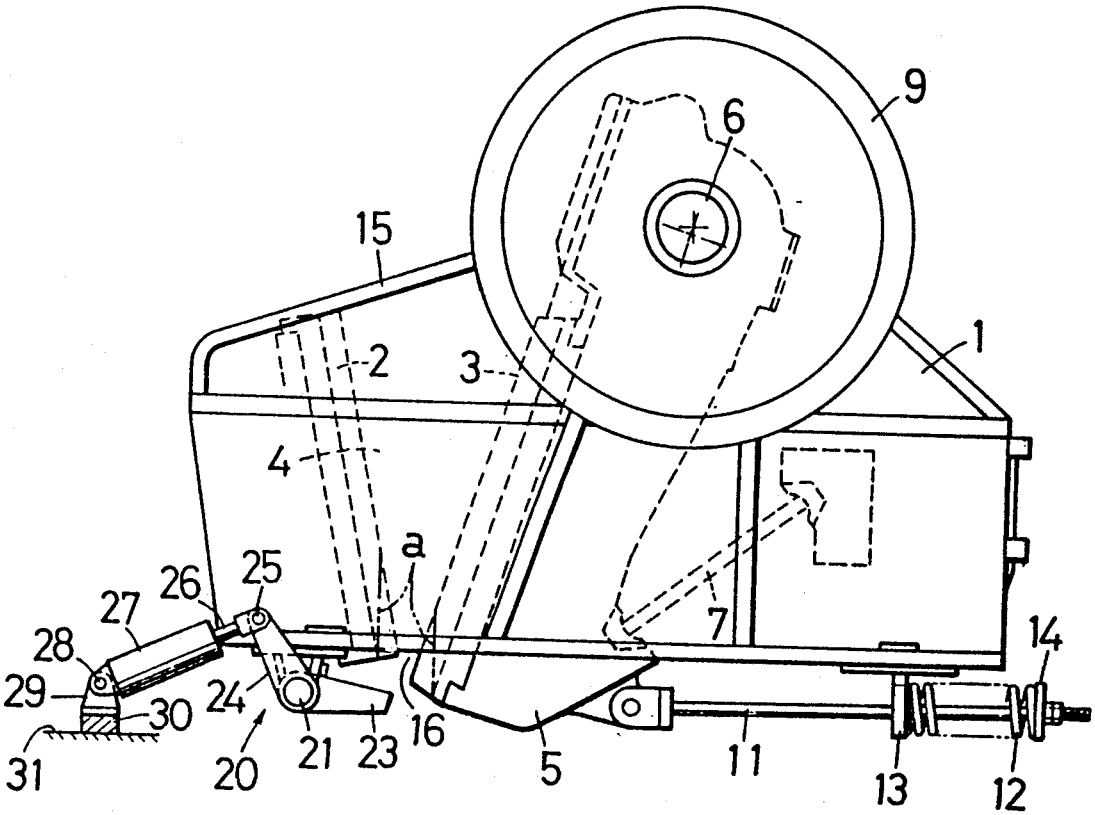
FIG. 2 is a side view of the jaw crusher shown in FIG. 1.

One embodiment of the present invention will be described below with reference to the accompanying drawings. FIG. 1 is a front view of one embodiment in which the present invention is applied to a crusher that is generally called "single-toggle type jaw crusher" (hereinafter referred to as "jaw crusher"). FIG. 2 is a side view of the jaw crusher as viewed from the left-hand side of FIG. 1. The jaw crusher has a body 1 that is made of steel plate. A fixed tooth plate 2 is secured to a wall surface inside the body 1.

A movable tooth plate 3 is disposed in opposing relation to the fixed tooth plate 2. A wedge-shaped crushing space 4 is defined between the fixed and movable tooth plates 2 and 3. The movable tooth plate 3 is secured to the front side of a swing jaw 5. The upper end of the swing jaw 5 is rotatably supported by an eccentric shaft 6. The lower end of the swing jaw 5 is supported by the forward end of a toggle plate 7 which abuts against it. The rear end of the toggle plate 7 is supported by the body 1. The eccentric shaft 6 is supported by the body 1 through bearings 8.

A flywheel 9 is attached to one end of the eccentric shaft 6, and a V-belt pulley 10 is secured to the other end thereof. The V-belt pulley 10 is driven to rotate by a motor (not shown) through a V-belt. The eccentric shaft 6 is rotated in response to the rotation of the V-belt pulley 10. In response to the rotation of the eccentric shaft 6, the swing jaw 5 moves up and down as well as back and forth.

Since the swing jaw 5 is supported by the toggle plate 7 from the back, the back-and-forth motion of the swing jaw 5 results in approximately circular motion along a circle the radius of which is defined by the toggle plate 7. The swing jaw 5 performs the vertical motion and the circular motion at the same time in response to the rotation of the eccentric shaft 6. The forward end of a rod 11 is rotatably attached to the rear portion of the lower end of the swing jaw 5 through a joint. A washer 14 is attached to the rear end of the rod 11 by a nut. A coil spring 12 is interposed between the washer 14 and a bracket 13.

Since the bracket 13 is secured to the body 1, the rod 11 constantly pulls the swing jaw 5 rearwardly. Accordingly, the swing jaw 5 performs the above-described approximately circular motion without separating from the forward end of the toggle plate 7.

Pass-through preventing device

When the above-described jaw crusher is used for a long time, the lower end portions of the fixed and movable tooth plates 2 and 3 become worn into shapes such as those shown by the one-dot chain lines a in FIG. 2. As a result, the size of a discharge opening 16 enlarges, so that an object to be crushed, particularly a planar slab, which is thrown into a loading opening 15 may pass through the discharge opening 16 without being crushed. A pass-through preventing device 20 is designed to prevent an object from passing through the discharge opening 16 without being crushed.

A fork shaft 21 is rotatably supported by bearings 22. The bearings 22 are secured to the lower side of the body 1 by means of bolts. A bush for buffer action, which is made of a hard rubber material, is inserted in each bearing 22 for the purpose of vibration isolation. Three equally spaced forks 23 are integrally connected to the fork shaft 21 by keys and bolts (not shown) or by welding. The forks 23 are spaced apart from each other at a predetermined distance in order to block the passage of an object to be crushed through the discharge opening 16. One end of a link 24 is secured to one end of the fork shaft 21.

The distal end of a piston rod 26 of a cylinder 27 is rotatably connected to the other end of the link 24 through a shaft 25. The cylinder 27 drives the fork shaft 21 to rotate. The rear end of the cylinder 27 is rotatably connected to a bracket 29 through a shaft 28. The bracket 29 is secured to either the body 1 or a frame 31 on which the jaw crusher is installed, by means of bolts (not shown) through a vibration insulator 30.

Operation of the pass-through preventing device 20

When the piston rod 26 is contracted by introducing hydraulic pressure into the cylinder 27, the link 24 is pivoted about the fork shaft 21. In consequence, each fork 23 is pivoted to a position where it faces the discharge opening 16 (i.e., the position shown in FIG. 2). If a relatively thin object to be crushed is thrown into the loading opening 15 in this state, it drops through the crushing space 4 and collides against the upper surfaces of some forks 23, thereby being stopped from passing through without being crushed. The forks 23 against which the object collides receive the impact. The impact force acts in such a manner as to twist the fork shaft 21 and pivot the link 24.

In consequence, the link 24 acts in such a manner as to drive the piston of the cylinder 27 through the piston rod 26. Although the piston compresses the oil in the cylinder 27, since the oil is sealed by a switching valve (not shown), the hydraulic pressure functions as a damper, so that the piston cannot move. In addition, the damper 30 lessens the impact. The object, which is blocked by the forks 23, is crushed in the crushing space 4 between the fixed and movable tooth plates 2 and 3, and the pieces of the crushed object are discharged through the discharge opening 16.

Second embodiment of the pass-through preventing device

Figure 3:
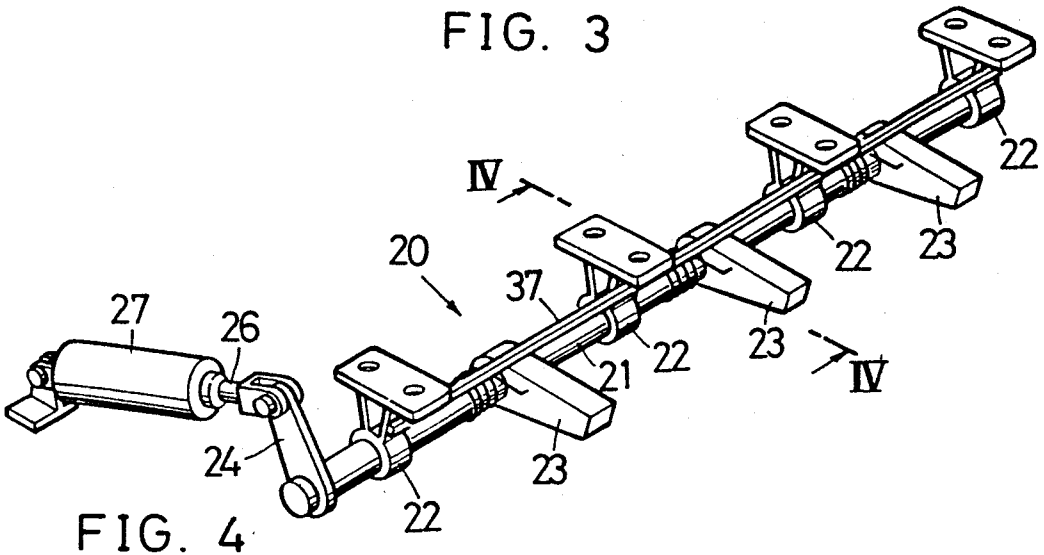
FIG. 3 shows the external appearance of a second embodiment of the pass-through preventing device.
Figure 4:
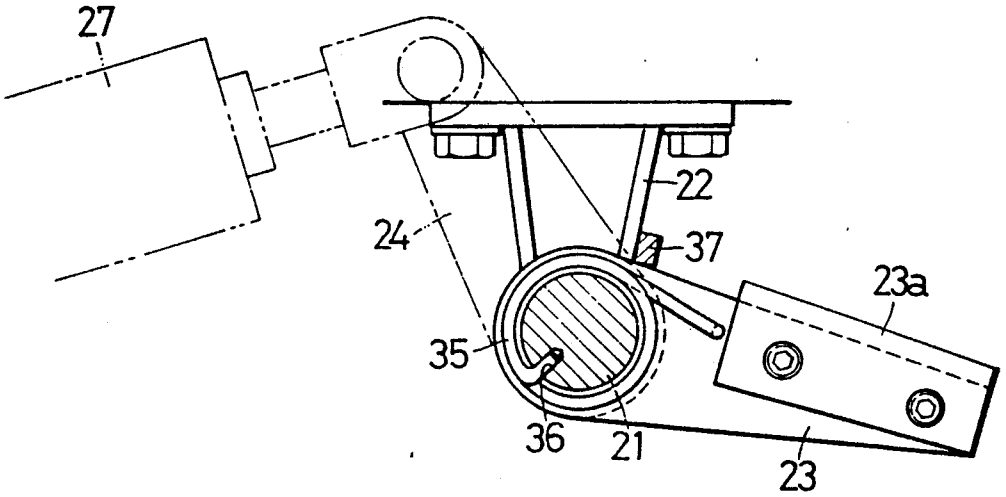
FIG. 4 is a sectional view taken along the line IV—IV of FIG. 3.

FIG. 3 shows the external appearance of a second embodiment. FIG. 4 is a sectional view taken along the line IV—IV of FIG. 3. The forks 23 in the first embodiment are rigidly secured to the fork shaft 21, whereas the forks 23 in the second embodiment are rotatably provided on the fork shaft 21. A coil spring 35 is interposed between each fork 23 and the fork shaft 21. One end of the coil spring 35 is inserted into a fixing hole 36 that is provided in the fork shaft 21.

The other end of the coil spring 35 is inserted into a insertion hole in the fork 23. In an assembled state where the coil springs 35 have been inserted in position, the forks 23 and the fork shaft 21 do not move relative to each other. The structures of the other portions are the same as those in the first embodiment. When the cylinder 27 is driven, the forks 23 are pivoted until they are pressed against a rod-shaped stopper 37. The forks 23 are thus stopped from pivoting in a state where the coil springs 35 are slightly wound up. Thus, in this state the forks 23 are constantly subjected to torsional torque.

In the second embodiment, even if a thin plate-shaped object of crushing collides against a fork 23, the torsional impact on the fork 23 is lessened by the coil spring 35. After the collision, the fork 23 is returned to the angular position of the stopper 39 by means of the resilient force from the coil spring 35. In addition, the impact of the object is deadened by the buffer action of the cylinder 27. It should be noted that a replaceable liner **23*a*, which is replaced with a new one when becoming worn, is attached to the distal end of each fork 23** by means of bolts.

Third embodiment of the pass-through preventing device

Figure 5:
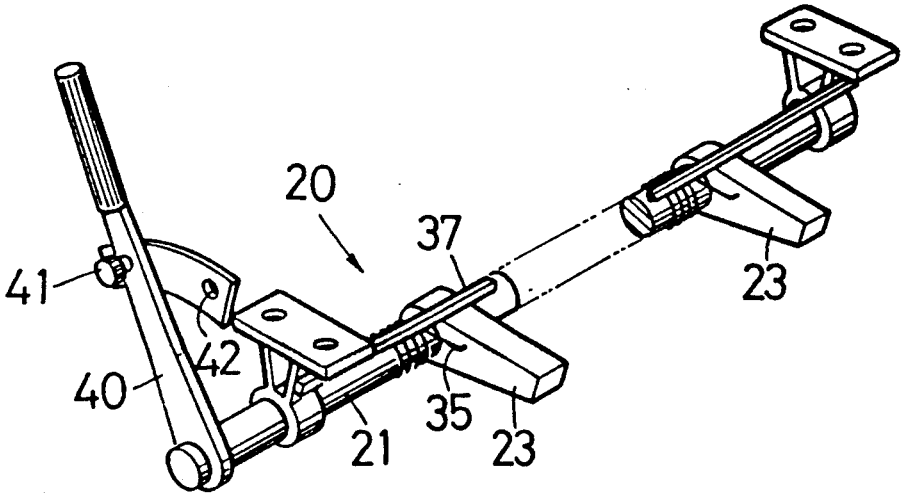
FIG. 5 shows the external appearance of a third embodiment of the pass-through preventing device.

FIG. 5 shows the external appearance of a third embodiment. The lower end of a hand-lever 40 is secured to one end of the fork shaft 21. A fixing bolt 41 is rotatably provided in the intermediate portion of the hand-lever 40. The fixing bolt 41 is selectively screwed into either one of the two positioning holes 42 to secure the hand-lever 40 to the body 1. When the pass-through preventing device is not used, the fixing bolt 41 is loosened and the hand-lever 40 is pivoted about the fork shaft 21 to retract the forks 23 from the discharge opening 16.

Other embodiments of the pass-through preventing device

Although the cylinder 27 in the first and second embodiments is an oil-hydraulic cylinder, a pneumatic cylinder may also be employed. The arrangement may also be such that the cylinder 27 in the first embodiment is replaced with a spring and the device for pivoting the forks 23 is adapted be hand-operated as in the third embodiment.

Movable tooth plate

Figure 6:
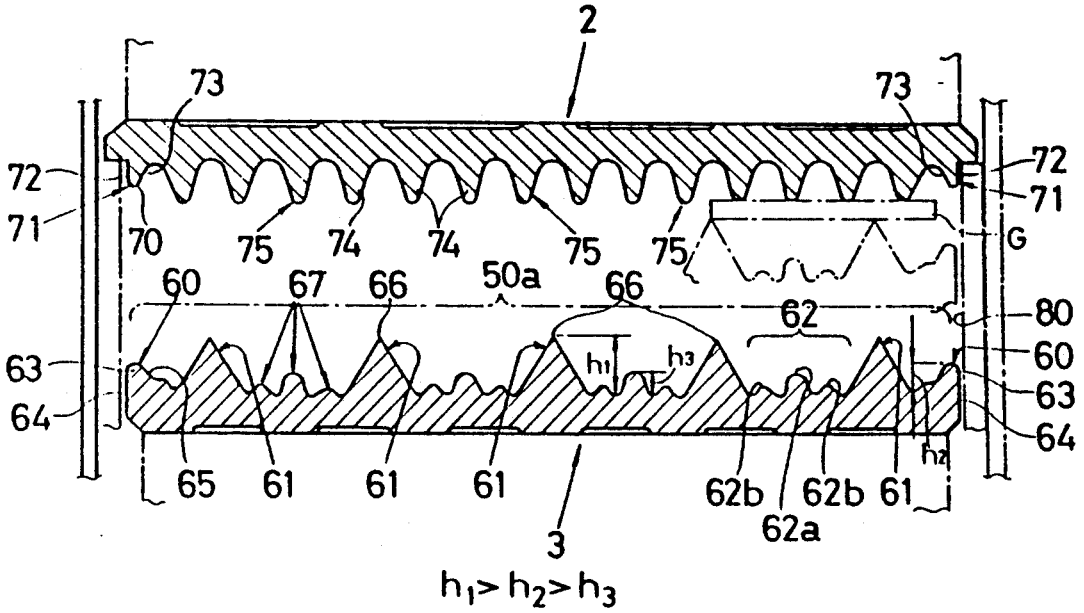
FIG. 6 is a sectional view of a first embodiment of the tooth plate structure according to the present invention.
Figure 7:
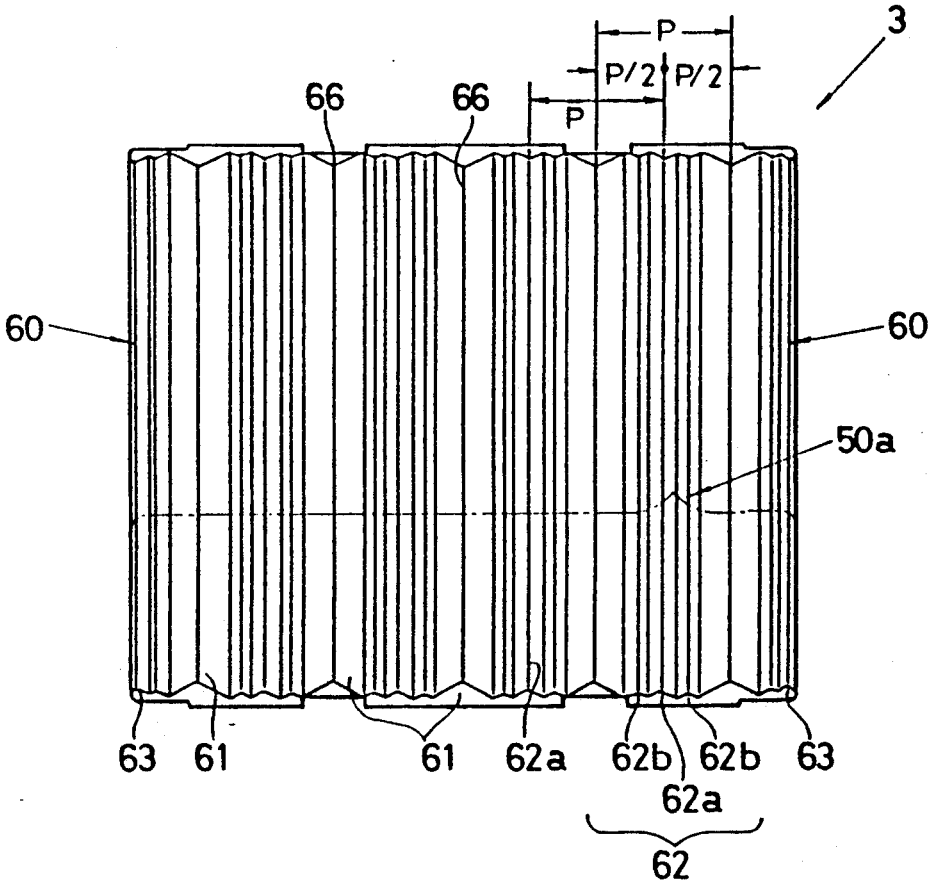
FIG. 7 is a plan view of the movable tooth plate shown in FIG. 6.
Figure 8:
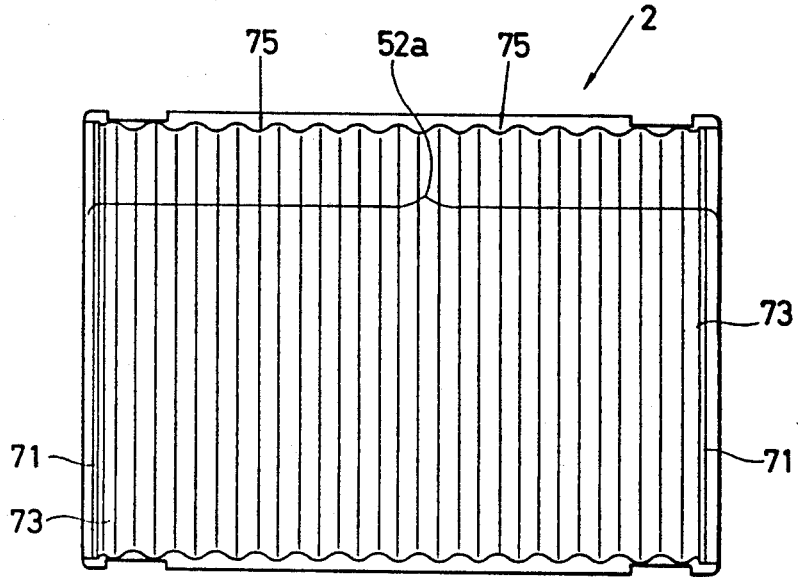
FIG. 8 is a plan view of the fixed tooth plate shown in FIG. 6.
Figure 8:
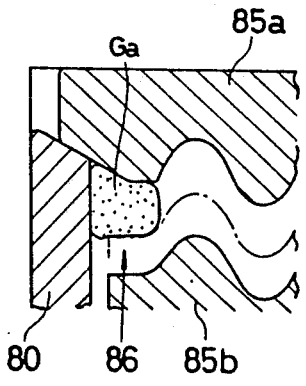
Figure 8:
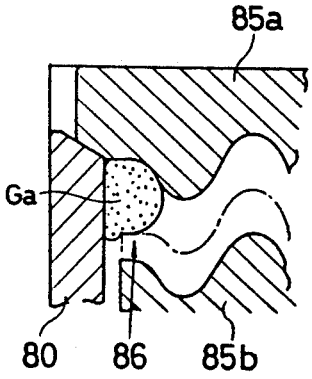
Figure 8:
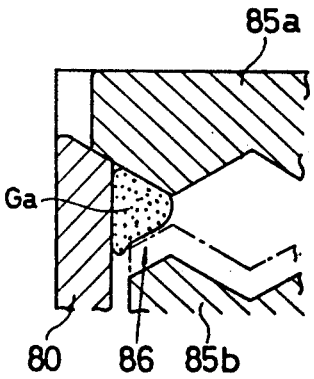

FIGS. 6, 7 and 8 show the crushing tooth plates of the jaw crusher. FIG. 6 is a sectional view of the fixed and movable tooth plates 2 and 3 in their assembled state; FIG. 7 is a plan view of the movable tooth plate 3; and FIG. 8 is a plan view of the fixed tooth plate 2. As shown in FIGS. 6 and 7, the movable tooth plate 3 comprises edge projections 60 that define left and right edges of a crushing face **50*a*, cutting projections 61 that first roughly cut a lump of asphalt G, for example, and groups 62** of intermediate crushing projections that break the pieces of the cut lump G into smaller pieces of appropriate size.

The top portion 63 of each edge projection 60 has a substantially semicircular cross-sectional configuration. One side of each edge projection 60 has a vertical surface 64 that extends parallel to the direction of swing of the movable tooth plate 3. The other side surface of the projection 60 is defined by a slant surface 65 that is stepwisely slanted (i.e., with two different angles of inclination) toward the center of the crushing face **50*a*. Each cutting projection 61 has a height $h_1$ from the root, which is greater than the height $h_2$ of the edge projections 60. In addition, the cutting projections 61 have acute-angled top portions 66 that are disposed at a constant pitch P along the crushing face 50*a***.

An intermediate crushing projection group 62 is disposed between each pair of adjacent cutting projections 61. The height of the intermediate crushing projections 62 is lower than that of the edge projections 60. The top portion 67 of each intermediate crushing projection has a substantially semicircular cross-sectional configuration. Each intermediate crushing projection group 62 comprises three projections each having a circular cross-section at the distal end. Among the three projections, only the central projection **62*a* is slightly higher ($h_3$) than the other projections 62*b*. The central projection 62*a* is disposed at the middle between each pair of adjacent cutting projections 61. In other words, the cutting projections 61 and the central projections 62*a*** are alternately disposed at a pitch of P/2.

Fixed tooth plate

The fixed tooth plate 2, which is disposed in opposing relation to the movable tooth plate 3, is formed such that each projection of the movable tooth plate 3 can function effectively to attain its own purpose. As shown in FIGS. 6 and 8, a projection 71 is disposed at each edge of a crushing face **52*a*. The top portion 70 of the projection 71 has a substantially semicircular cross-sectional configuration. One side of the projection 71 is defined by a slant surface 73 that is slanted toward the center of the crushing face 52*a*. Projections 74 are formed in the intermediate portion of the crushing face 52*a* of the fixed tooth plate 2 at a constant pitch and with the same height. The top portion 75 of each projection 74** has a semicircular cross-sectional configuration.

Each cutting projection 61 of the movable tooth plate 3 faces the root between a pair of adjacent projections 74 of the fixed tooth plate 2. In each intermediate crushing projection group 62, only the central projection **62*a* faces the top portion 75 of a projection 74. The projection 62*b*, which is disposed at each side of the central projection 62***a*, faces the root between a pair of adjacent projections 74.

Operation

The jaw crusher of this embodiment has the abovedescribed tooth plate structure for crushing a non-rigid object, and the movable tooth plate 3 is attached to the swing jaw 5, while the fixed tooth plate 2 is attached to the body 1. In the assembled state, the vertical surfaces 64 of the edge projections 60, which are at the left and right ends of the movable tooth plate 3, and the vertical surfaces 72 of the projections 71, which are at the left and right ends of the fixed tooth plate 3, are disposed extremely close to the surfaces of associated cheek plates 80, so that the top portions 63 and 70 of these projections are in close proximity to the cheek plates 80, as shown in FIG. 6.

When the movable tooth plate 3 is swung, the cutting projections 61, which are the highest ($h_1$), first approach the fixed tooth plate 2 and then the intermediate crushing projection groups 62 do. A lump G of asphalt thrown in is first bent between the cutting projections 61 and the projections 74 of the fixed tooth plate 2 and cut by the wedge effect of the cutting projections 61. In other words, the cutting projections 61 perform cutting by bending and cutting by the wedge action. Thereafter, the pieces of the lump G thus cut are further cut by the cooperation of the central projections 62*a* in the intermediate crushing projection groups 62 and the projections 74 of the fixed tooth plate 2 and are then further broken into smaller pieces by the crushing projections 62*b* at both sides of each central projection 62*a*.

The edge projections 71 of the fixed tooth plate 2 cooperate with the edge projections 60 of the movable tooth plate 3 to break an object of crushing, for example, a lump G of asphalt, which is near the associated cheek plates 80. For this reason, the object G is always pushed toward the center of the tooth plate structure by the slant surface 65 of the edge projection 60 of the movable tooth plate 3 and the slant surface 73 of the projection 71 provided at each edge of the fixed tooth plate 2. Accordingly, there is no possibility of either side of the crushing tooth plate structure being clogged with the object G.

As has been described above, since according to this embodiment flexural projections and crushing projections are alternately provided on the crushing face at a constant pitch, a non-rigid object, for example, a lump of asphalt, can be efficiently crushed. In addition, since the projections 60 and 71 are provided at the left and right ends of the movable and fixed tooth plates 3 and 2 in opposing relation to each other and a vertical surface is formed on the side of each of the projections 60 and 71 which is closer to the associated cheek plate 80, a relatively soft object of crushing which is near the cheek plate 80 is pushed toward the center of the tooth plate structure, so that there is no possibility of such an object sticking to the area between the cheek plate and the crushing tooth plates.

In other words, the slant surfaces 65 and 73 always act in such a manner as to move the object of crushing toward the center of the crushing tooth plates. Accordingly, it is possible to facilitate the falling of the object and hence improve the crushing capacity of the jaw crusher.

Second and third embodiments of fixed and movable tooth plates

Figure 9:
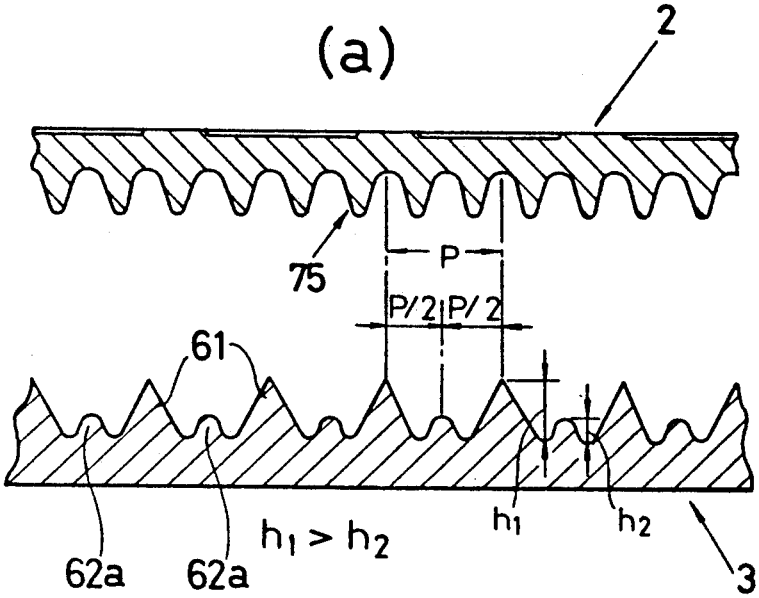
FIG. 9(*a*) is a sectional view of a second embodiment of the tooth plate structure.
Figure 9:
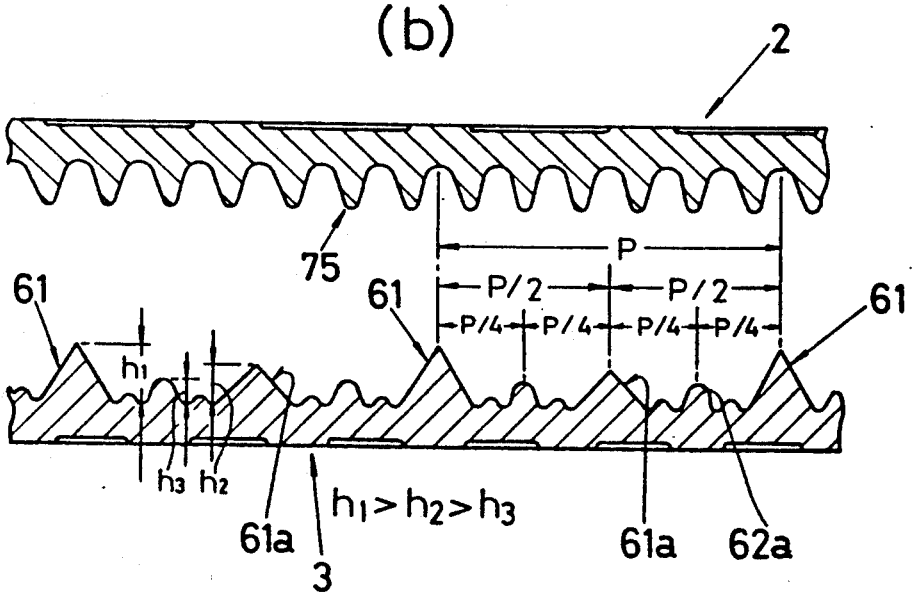

Although one embodiment of the fixed and movable tooth plates according to the present invention has been detailed with reference to the drawings, it should be noted that the arrangements of the fixed and movable tooth plates are not necessarily limited to those in this embodiment and that various changes and modifications may be imparted thereto without departing from the gist of the present invention. FIG. 9(*a*) shows a second embodiment, in which an intermediate projection 62*a* with a height $h_2$ is provided at the middle between a pair of adjacent cutting projections 61 with a height $h_1$, that is, the cutting projections 61 and the intermediate projections 62*a* are alternately disposed at a pitch of P/2. The heights of the two different kinds of projection are set to satisfy the relation of $h_1 > h_2$.

FIG. 9(*b*) shows a third embodiment, in which a second cutting projection 61*a* is provided at the middle between each pair of adjacent cutting projections 61. The height $h_2$ of the second cutting projections 61*a* is lower than the height $h_1$ of the cutting projections 61. In addition, an intermediate projection 62*a* is provided at the middle (P/4) between a cutting projection 61 and a neighboring second cutting projection 61*a*. The height $h_3$ of the intermediate projections 62*a* is lower than the height $h_2$ of the second cutting projections 61*a*.

The relationship between the heights $h_1$, $h_2$ and $h_3$ is $h_1 > h_2 > h_3$. Although in the above-described embodiment each edge projection 60 of the movable tooth plate 3 is formed with a slant surface 65 that is stepwisely slanted (i.e., with two different angles of inclination), it should be noted that the configuration of the slant surface 65 is not necessarily limitative thereto and that the slant surface 65 may have any desired configuration.

What is claimed is:

1. A jaw crusher for breaking a non-rigid object comprising:

a) a body;

b) a fixed tooth plate which is secured to said body;

c) a movable tooth plate which is swingably provided at an acute angle to said fixed tooth plate to provide therebetween a crushing space for breaking the non-rigid object which is to be crushed;

d) a swing jaw to which said movable tooth plate is secured;

e) a driving mechanism for swinging said swing jaw;

f) a motor for driving said driving mechanism;

g) a plurality of forks which are provided at the lower end of said crushing space to prevent said object from passing through said crushing space without being crushed;

h) a fork shaft which is provided with one end of each of said forks and which is provided on said body; and i) means for rotating said fords toward and away from said fixed and movable tooth plates.

2. A jaw crusher according to claim 1, wherein said means for rotating comprises a cylinder device which is connected to one end of said fork shaft to rotate it, thereby driving said forks to rotate.

3. A jaw crusher according to claim 1 or 2, further comprising buffer means for lessening impact energy that is generated when said object collides against said forks.

4. The jaw crusher of claim 1, wherein said means for rotating further comprises bearings secured to the lower side of said body for rotatably supporting said fork shaft, and a shaft driving mechanism connected to a first end of said fork shaft for rotatably driving said fork shaft with said plurality of forks thereon.

5. The jaw crusher of claim 1, wherein said means for rotating further comprises means for pivoting said plurality of forks relative to said fork shaft.

6. The jaw crusher of claim 5, wherein said pivoting means further comprises a coil spring provided between each fork and said fork shaft.

7. The jaw of claim 6, wherein one end of each coil spring is provided within a fixing hole within said fork shaft and the other end of said coil spring is provided within an insertion hole on each respective fork.

8. A jaw crusher for breaking a non-rigid object comprising:

a body;

a fixed tooth plate which is secured to said body;

a movable tooth plate which is swingably provided at an acute angle to said fixed tooth plate to provide therebetween a crushing space for crushing said non-rigid object;

a swing jaw to which said movable tooth plate is secured;

a driving mechanism for swinging said swing jaw;

a motor for driving said driving mechanism;

first projections provided on one of said fixed and movable tooth plates, each first projection being at a constant pitch and having a constant height, first projection root portions being formed between adjacent first projections;

cutting projections provided on the other of said fixed and movable tooth plates; each cutting projection having a constant pitch and a constant height and projecting towards a respective first projection root portion, said cutting projections for bending and cutting said non-rigid object placed between said fixed and movable plates, wherein each of said cutting projections comprises a top portion formed as an acute angle at the top of each cutting projection;

first crushing projections, each of which is provided substantially in the middle between each pair of adjacent cutting projections, said first crushing projections being lower in height than said cutting projections.

second crushing projections provided on said fixed and movable tooth plates at each end thereof with respective top portions facing each other, said second crushing projections having a height greater than said first crushing projections but less than said cutting projections; and vertical surfaces formed and said second crushing projections at one end thereof, said vertical surfaces extending parallel to the direction of swing of said movable tooth plate.

* * * * *